US005437234A

United States Patent [19]

Duer

[11] Patent Number: 5,437,234

[45] Date of Patent: Aug. 1, 1995

[54] ASSEMBLY FOR SECURING A GONDOLA OR A CHAIR TO A SUSPENSION BAR

[75] Inventor: Herbert Duer, Schwarzach, Austria

[73] Assignee: Konrad Doppelmayr & Sohn Maschinenfabrik Gesellschaft m.b.H. & Co. KG, Wolfurt, Austria

[21] Appl. No.: 240,689

[22] PCT Filed: Nov. 5, 1992

[86] PCT No.: PCT/AT92/00141

§ 371 Date: May 5, 1994

§ 102(e) Date: May 5, 1994

[87] PCT Pub. No.: WO93/09013

PCT Pub. Date: May 13, 1993

[30] Foreign Application Priority Data

Nov. 5, 1991 [AT] Austria ..... 2192/91

[51] Int. Cl.[6] ..... B61B 12/00

[52] U.S. Cl. ..... 105/149.1; 105/148; 105/453

[58] Field of Search ..... 105/148, 149.1, 149.2, 105/156, 149, 453; 104/89

[56] References Cited

U.S. PATENT DOCUMENTS 3,559,583 2/1971 Chadenson ..... 104/89

FOREIGN PATENT DOCUMENTS 0015205 3/1980 European Pat. Off. ..... 105/148
2638431 9/1978 Germany ..... 105/148
1409271 10/1975 United Kingdom ..... 105/148
0905161 2/1982 U.S.S.R. ..... 105/148

*Primary Examiner*—Mark T. Le
*Attorney, Agent, or Firm*—Herbert L. Lerner; Laurence A. Greenberg

[57] ABSTRACT

An assembly for securing a gondola (5) or chair of a cableway system to a suspension bar (1), which is embodied on its lower end with a support device (2) that fits under a load-bearing structure (3) for the gondola (5) or chair, wherein at least one damping element (4) in the form of an inflatable vessel is disposed between the support device (2) and the load-bearing structure (3). At least two and in particular four mutually spaced-apart air or gas springs (4), on which the load-bearing structure (3) rests, are provided on the support device (2) (FIG. 1 ).

12 Claims, 5 Drawing Sheets

ASSEMBLY FOR SECURING A GONDOLA OR A CHAIR TO A SUSPENSION BAR

Figure 1:
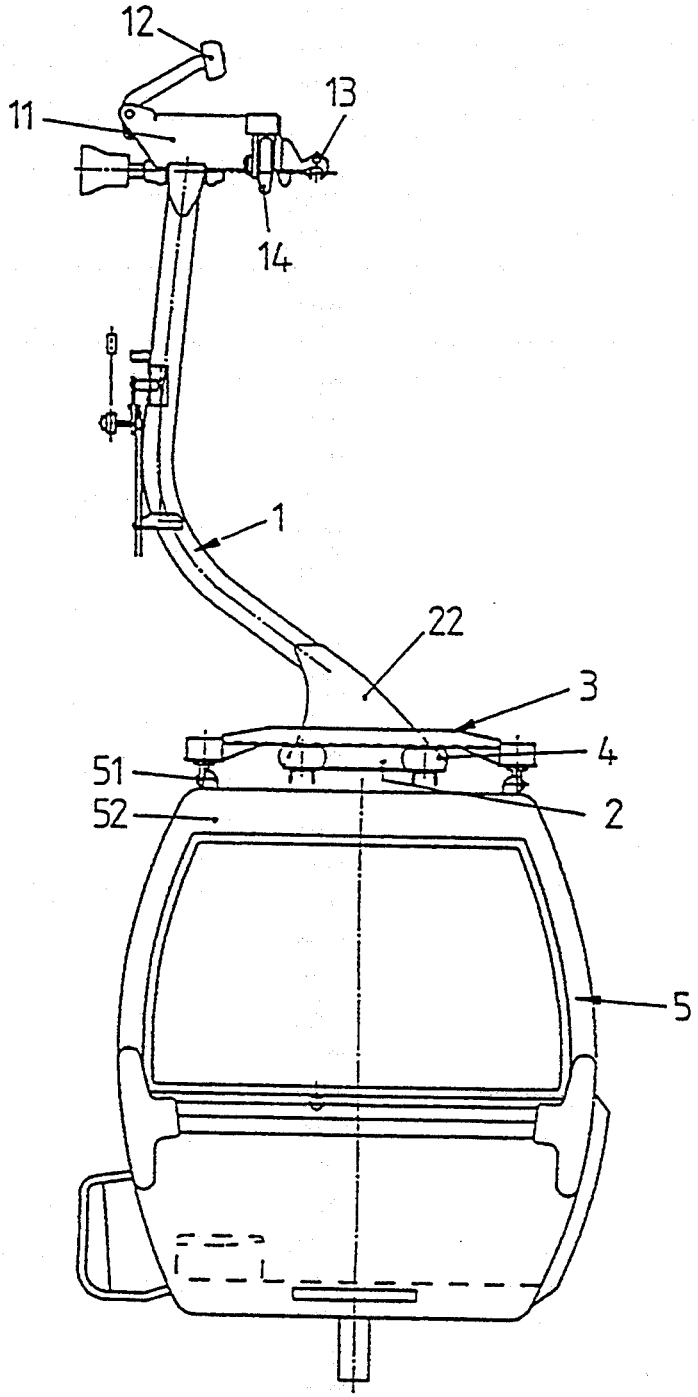

The present invention relates to an assembly for securing a gondola or chair of an overhead cableway system to a suspension bar (hanger), which is embodied on its lower end with a support device that fits under a load-bearing structure for the gondola or chair, wherein at least one damping element in the form of an inflatable vessel is disposed between the support device and the load-bearing structure.

In known apparatus of this kind, a support device is pivotably connected to the lower end of the suspension bar, which in particular is clamped fixedly or releasably to the feed cable by means of a clamp device, the support device being embodied with four support arms, for instance, whose free ends are penetrated by bolts anchored in the gondola. To attain an elastically damping fastening to the support arms, sleeves are provided into which cylindrical damping bodies are inserted that are penetrated by the bolts, and retaining disks are disposed on the upper ends of the bolts.

However, these known fasteners do not meet the demands made of them, because as a result of excessive compression of the damping bodies, as well as aging of the material of the damping bodies and other factors, shocks that are caused by the motion of the clamping jaws via the cable rollers are transmitted to the gondola via the suspension bar, and as a result a number of shocks reach the gondola as it passes over the cable rollers. This also causes cable vibration and generates noise.

These disadvantageous effects are becoming increasingly important, because the speeds of cableway systems are higher and higher, to increase the carrying capacity; and this increases the shocks caused when the gondola travels over sets of rollers. Conversely, though, the passengers are looking for an increasingly comfortable ride.

Another disadvantage of known apparatus is that for the sake of strength, when the gondola is secured to the suspension bar the fastening bolts must be located in the peripheral regions of the roof of the gondola. Conversely, however, to avert torque exerted by the gondola on the suspension bar, the fastening of the suspension bar should be located in the middle region of the gondola roof. To avert the exertion of torque on the suspension bar, it is therefore necessary, in known fasteners, to dispose a joint between the suspension bar and the support device.

An apparatus for elastically suspending a cableway gondola is disclosed in European Patent disclosure EP-A 015 205; this apparatus is embodied by a damping element, in the form of an inflatable tire, disposed between a support device secured on the suspension bar and a load-bearing frame connected to a gondola. However, this apparatus does not meet requirements because if the damping element should fail, for instance if air escapes from it as a result of damage, the damping action sought is not guaranteed. Moreover, this damping element is of the kind that must be made specially for this particular intended application.

By comparison, the object of the present invention is to create a damping device by which the calm motion of the gondola or chair that is sought is assured even at high travel speed, which enables suspension of the gondola or chair from the suspension bar without a joint located between the support device and the load-bearing structure, which can be manufactured in a simple way because it is made of devices that are available on the market, and which is still functional even if some of the devices fail. These disadvantages of the known prior art are avoided according to the invention in that at least two and in particular four spaced-apart air or gas springs, on which the load-bearing structure rests, are provided on the support device.

Since the damping devices thus comprise commercially available components, namely gas springs or air springs, this assembly can be manufactured in a simple way. Since moreover at least two gas springs or air springs are disposed between the support device and the load-bearing structure, the damping action sought is at least partially assured even if one of these parts fails because of a malfunction.

Preferably, the support device has two substantially parallel support rails, on each of whose free ends at least one damping element is disposed, and the load-bearing structure has two parallel rails, which are oriented transversely to the support rails and which rest on the air or gas springs. The support device may have two brackets, connected to the suspension bar rod, on which brackets the support rails are secured, and the load-bearing structure may be formed by two parallel rails and two rails, extending transversely thereto, on which free ends the gondola or chair is secured.

In a further preferred embodiment, the gondola or chair is pivotably connected to the load-bearing structure by means of substantially horizontally oriented bolts, as a result of which it is pivotable relative thereto. The load-bearing structure may be embodied in its outer region with downwardly projecting braces (tabs), which are penetrated by support bolts for the gondola.

In a further preferred embodiment, the load-bearing structure is embodied with a wall extending in rooflike fashion, wherein the air or gas springs are disposed between the support device and this wall. Moreover, the load-bearing structure may be embodied with two vertically spaced-apart walls, between which the support device is disposed, and air or gas springs are disposed both above and below the support device. Moreover, the air or gas springs may communicate by means of lines with one another and with a central pressure fluid supply.

In a further preferred embodiment, at least one additional mechanical damping device is provided between the support device and the load-bearing structure, which in particular is formed by rubber buffers and a tie rod.

Figure 2:
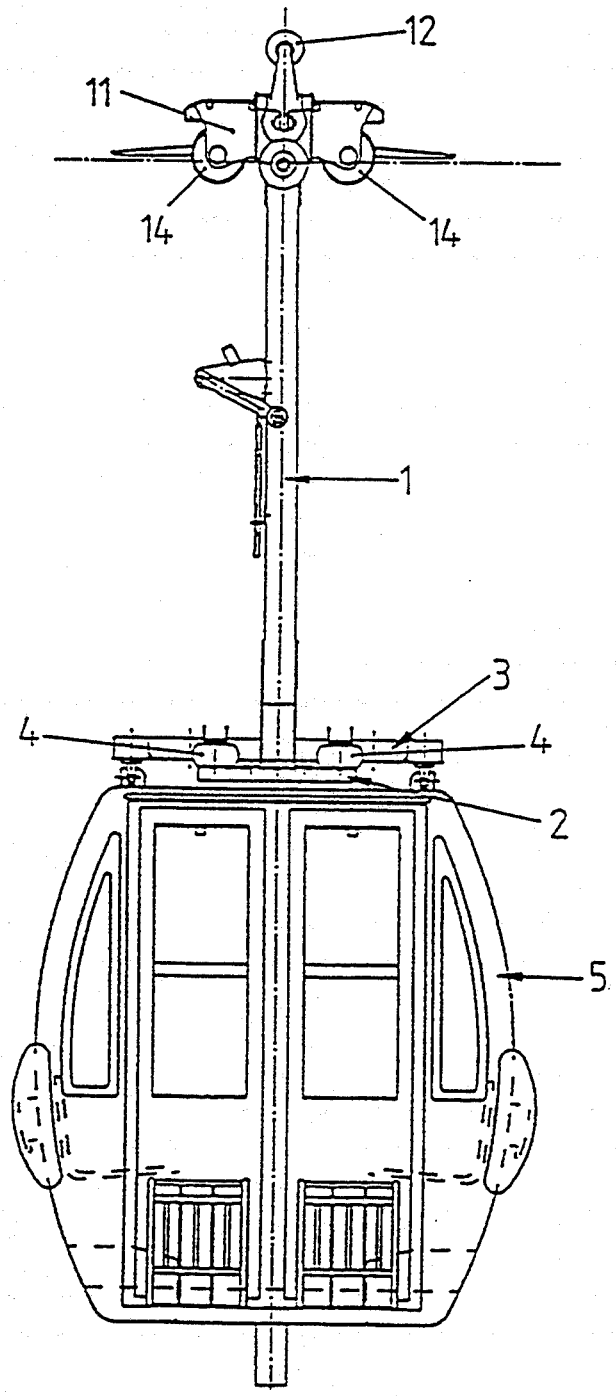
Figure 3:
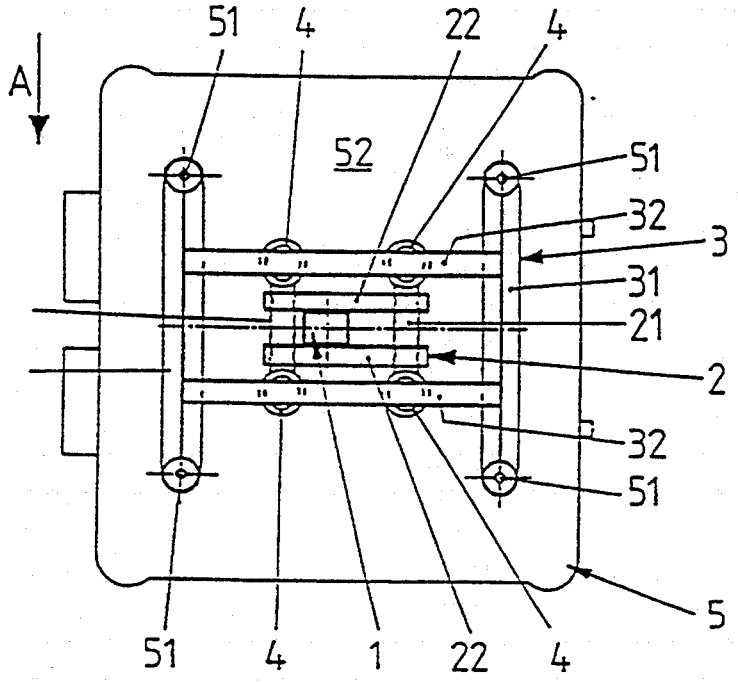
Figure 4:
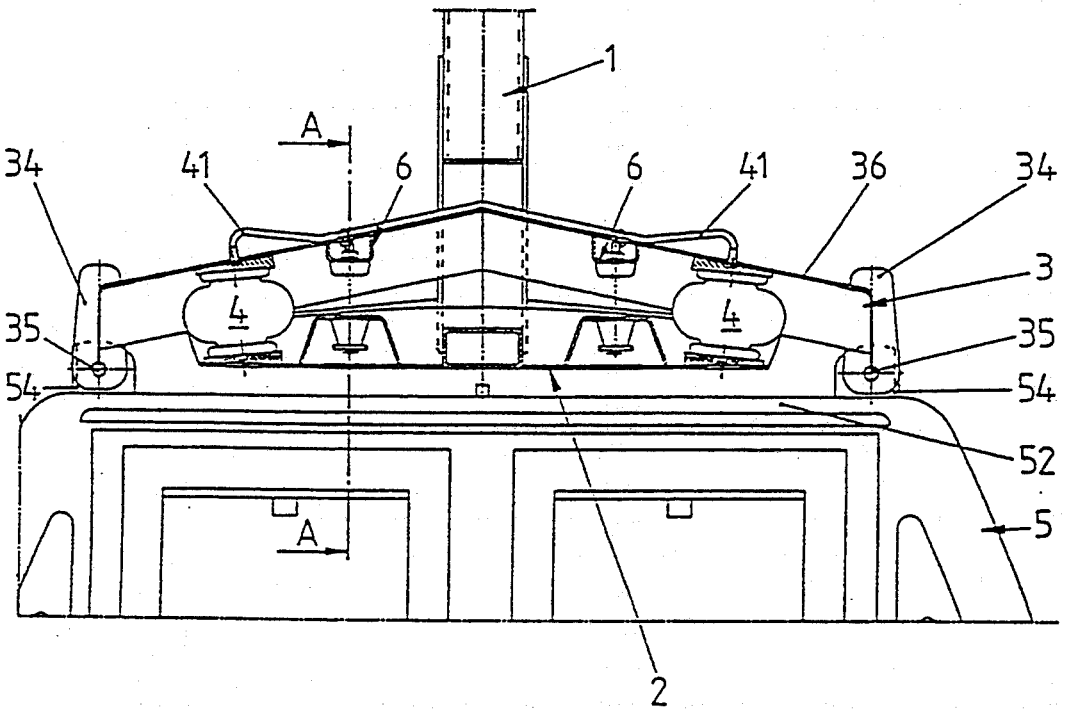
Figure 5:
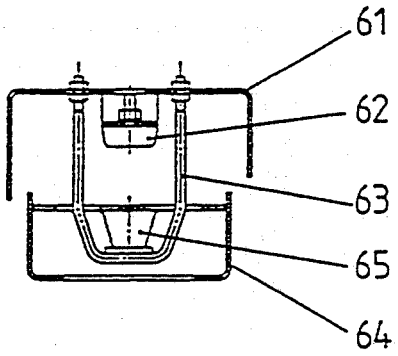
Figure 6:
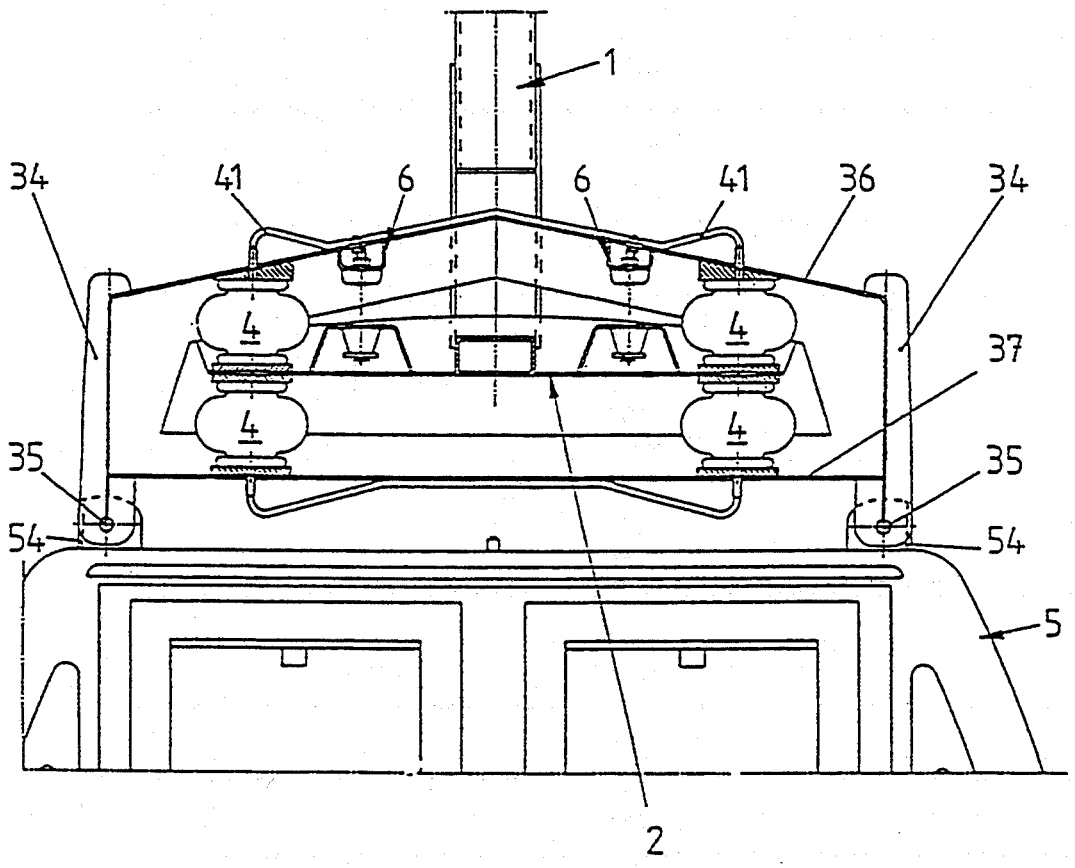

The assembly according to the invention is described in detail below in terms of exemplary embodiments shown in drawing. Shown are:

FIG. 1, a cableway gondola secured to a suspension bar rod, in a front view;

FIG. 2, this cableway gondola in a side view;

FIG. 3, this cableway gondola in a plan view;

FIG. 4, a different embodiment of an assembly for fastening a gondola to a suspension bar rod, in vertical section;

FIG. 5, a detail in section in the direction of the arrows A—A in FIG. 4, on a larger scale than FIG. 4; and FIG. 6, an embodiment modified over FIG. 4 of an assembly for securing a gondola to a suspension bar rod, in vertical section.

As can be seen from FIG. 1 and 2, a gondola 5 is fastened to the lower end of a suspension bar rod 1 by means of an assembly 2 and 3. A clamp body 11, clamps jaws 13 adjustable by means of a control roller 12, and rollers 14 of a pulling cradle are disposed on the upper end of the suspension bar rod 1. The suspension bar rod 1 can be coupled to a feed cable by means of the clamp jaws 13.

The fastening assembly comprises a support device 2, disposed on the lower end of the suspension bar rod 1, and a load-bearing structure 3, secured to the roof 52 of the gondola 5. As can also be seen from FIG. 3, the support device 2 comprises two rails 21 oriented in the travel direction A of the gondola 5 and two brackets 22, extending transversely thereto, which are rigidly joined to the side faces of the suspension bar rod 1. The load-bearing structure 3 likewise comprises two rails 31 extending into the travel direction A of the gondola 5, joined together by two rails 32 aligned transversely to them. The load-bearing structure 3 is joined to the gondola 5 in that bolts 51 which are anchored in the roof 52 of the gondola 5 are provided on the free ends of the rails 31. Air or gas springs 4 are disposed between the support device 2 and the load-bearing structure 3; they are located between the free ends of the rails 21 of the support device 2 and the rails 32 of the load-bearing structure 3.

Because the fastening of the gondola 5 to the load-bearing structure 3 and the fastening of the load-bearing structure 3 to the support device 2 are located at separate points from one another, the demands for a stable fastening of the gondola 5 and for avoidance of torque exerted on the suspension bar rod 1 are met in a simple way. Furthermore, by the disposition of air or gas springs 4 between the load-bearing structure 3 and the support device 2, an optimally spring fastening of the gondola 5 is attained; hence the shocks caused by the motion of the cable clamps over the cable rollers are not transmitted to the gondola 5, and the gondola is subjected to much slighter mechanical strains. Moreover, this damps the transmission of noise. FIG. 4 shows a different embodiment of a fastening assembly according to the invention. The load-bearing structure 3 is embodied on its free ends with tabs 34, which are each provided with a bore, and tabs 54, each likewise provided with a bore, protrude from the roof 52 of the gondola 5; the bores of the tabs 34 and 54 are penetrated by hinge bolts 35. As a result, the gondola 5 is slightly pivotable relative to the load-bearing structure 3.

The load-bearing structure 3, embodied with a rooflike wall 36, is penetrated by the suspension bar rod 1, to which the support device 2 is secured. A plurality of air springs 4 are disposed between the free ends or the outer edge of the support device 2 and the wall 36 of the load-bearing structure 3. The air springs 4 communicate by means of lines 41 with one another and with a central air supply. As a result, the pressure prevailing in the air springs 4 can be controlled to meet requirements. The axis of the air springs 4 forms a small acute angle with the axis of the suspension bar rod 1.

In addition, additional mechanical damping devices 6, which are shown in FIG. 5, are provided between the support device 2 and the load-bearing structure 3. These devices comprise a housing 61, open toward the bottom and disposed on the underside of the wall 36, with a rubber buffer 62, a tie rod 63, and a housing 64, disposed on the support device 2, with a rubber buffer 65. The upper rubber buffer 62 protrudes downward from the housing 61, and the lower rubber buffer 65 protrudes downward from a wall of the housing 64. The tie rod 63 is anchored in the housing 61, surrounds the upper rubber buffer 62, and rests on the lower rubber buffer 65. As a result of these mechanical damping devices 6, motions that the support device 2 executes relative to the load-bearing structure 3 are limited because either the upper rubber buffer 62 comes to rest on the lower housing 64, or the motion of the support device 2 and load-bearing structure 3 away from one another is limited by the tie rod 63.

FIG. 6 shows a variant embodiment in which the load-bearing structure 3 has in addition to the rooflike wall 36 a lower, flat wall 37; a first group of air springs 4 is provided between the support device 2 and the wall 36, and a second group of air springs 4 is provided between the support device 2 and the wall 37. Further improvement in the damping action is attained as a result.

Instead of the air springs, gas springs may also be provided. Because of the damping elements provided between the support device and the load-bearing structure, the transmission of shocks and noises from the clamping device to the gondola via the suspension bar rod is averted.

An assembly of this kind for suspending gondolas or chairs can be employed with arbitrary types of cable cars. For instance, the suspension bar may be clamped fixedly to the support cable, or the clamps may be disconnectable from the support cable in the stations. The suspension bar may also be embodied with a pulling cradle, as a result of which the suspension bar, decoupled from the support cable, is movable with the gondola along rails in the stations, or the suspension bar is movable with the gondola along a support cable.

I claim:

1. A system including an assembly for securing a gondola or chair of a cable car system to a suspension bar, comprising:

a support device attached at a lower end of a suspension bar attached to a supporting cable;

a load-bearing structure attached at a gondola or chair of a cable car system; and at least two damping elements arranged in parallel and disposed between said load-bearing structure and said support device such that said support device supports said load-bearing structure via said at least two damping elements;

said at least two damping elements each being in the form of an inflatable vessel.

2. The system according to claim 1, wherein said at least two damping elements are four damping elements.

3. The system according to claim 1, wherein said damping elements are one of air springs and gas springs.

4. The system according to claim 2, wherein said support device comprises two substantially parallel support rails each having two free ends, each of said damping elements being disposed at a respective one of said free ends, wherein said load-bearing structure comprises two substantially parallel rails oriented transversely relative to said support rails and resting on said damping elements.

5. The assembly according to claims 4, wherein said support device includes two brackets connected to the suspension bar, said support rails being secured on said brackets, and said load-bearing structure including two further rails extending transversely to said substantially parallel rails, said two further rails having means for securing the gondola or chair thereto.

6. The system according to claim 2, including substantially horizontally extending support bolts pivotally connecting said load-bearing structure to the gondola or chair.

7. The system according to claim 4, including downwardly projecting braces formed on outer regions of said load-bearing structure, said support bolts penetrating said braces and supporting the gondola or chair.

8. The system according to claim 2, wherein said load-bearing structure is formed as a roof-like wall, and wherein said dampening elements are disposed between said support device and said wall.

9. The system according to claim 2, wherein said load-bearing structure comprises two walls disposed in a vertically spaced-apart relationship, said support device being disposed between said two walls, and wherein said damping elements are disposed both above and below said support device.

10. The system according to claim 2, wherein said damping elements are fluidically actuated damping elements, and including a central pressure fluid supply and lines by which said damping elements communicate with one another and with said central pressure fluid supply.

11. The system according to claim 2, including at least one additional mechanical damping device disposed between said support device and said load-bearing structure.

12. The system according to claim 11, wherein said at least one additional mechanical damping device is embodied by rubber buffers and a tie rod.

* * * * *